United States Patent [19]

Forberg et al.

[11] 4,434,542

[45] Mar. 6, 1984

[54] TOOL FOR ELECTRICALLY CONNECTING INSULATED WIRES

[75] Inventors: Horst Forberg; Hermann Herfort; Gunter Hegner; Manfred Müller, all of Berlin, Fed. Rep. of Germany

[73] Assignee: Krone GmbH, Berlin, Fed. Rep. of Germany

[21] Appl. No.: 263,699

[22] Filed: May 14, 1981

[30] Foreign Application Priority Data

May 20, 1980 [DE] Fed. Rep. of Germany ... 8013494[U]

[51] Int. Cl.[3] ..... H01R 43/00

[52] U.S. Cl. ..... 29/566.4; 7/107; 29/33 M; 29/278; 29/751

[58] Field of Search ..... 29/566.4, 566.3, 566.2, 29/566.1, 33 M, 56.5, 278, 747, 748, 750, 751, 752; 7/158, 107, 130, 131, 133, 134

[56] References Cited

U.S. PATENT DOCUMENTS 3,711,921 1/1973 Debortoli et al. ..... 29/56.5
3,883,316 5/1975 Mason ..... 29/566.4
4,241,496 12/1980 Grepson ..... 29/751

FOREIGN PATENT DOCUMENTS 2109280 9/1972 Fed. Rep. of Germany ..... 29/751

*Primary Examiner*—Z. R. Bilinsky
*Attorney, Agent, or Firm*—Brown & Martin

[57] ABSTRACT

The invention relates to a tool for the wiring of terminal elements which permits a plurality of separate operations such as connecting and withdrawing of a wire to and from a terminal element, respectively, and severing of the wire, to be carried out, and which may be manufactured at low cost because of its simple structure. To this end the tool comprises a bipartite plastic grip member (3) accommodating a ram (2) and a striker mechanism. On a protruding ram head (2*a*) there is provided a wire cutter (6) which may be actuated through a pin-and-slot guide (5, 6*c*) during a connecting operation. Locking means function to releasably connect the ram (2) to a slider (8) accommodated within the grip member (3) so as to be longitudinally movable.

9 Claims, 2 Drawing Figures

TOOL FOR ELECTRICALLY CONNECTING INSULATED WIRES

Figure 1A:
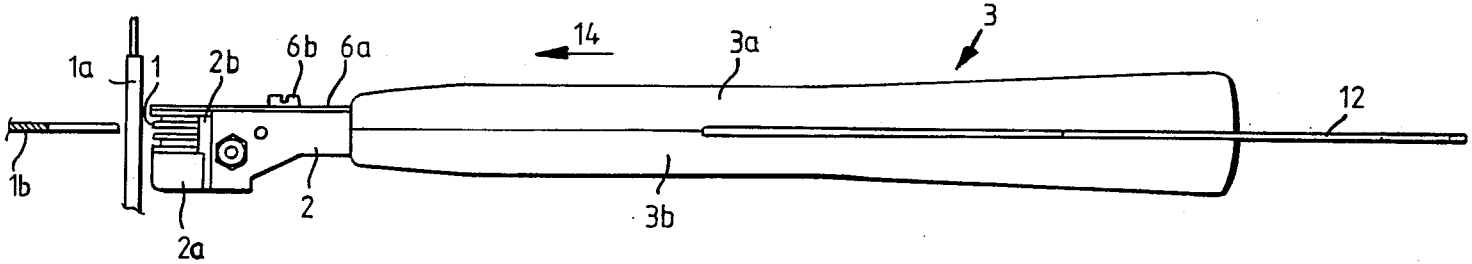

The present invention relates to a tool for electrically connecting insulated wires to a longitudinally slotted terminal element, comprising a hollow grip member in which a striker mechanism and a ram are disposed so as to be longitudinally movable against spring forces, the ram head projecting from the grip member being adapted for transversely urging the end of the insulated wire into the contact slot defined by two resilient tongues of the terminal element.

The Applicant has developed a connecting technique for connecting in a solderless, screwless and stripless manner insulated wires to terminal contacts, which has been widely accepted in the concerned field under the designation solderless, screwless and stripless connecting technique. This technique uses terminal elements of thin spring sheet-metal mounted so as to extend upright in a terminal strip. These terminal elements define an open longitudinal slot between two lateral resilient tongues, the width of said slot being slightly smaller than the diameter of the wire to be connected. The resilient tongues are offset relative to one another by deforming such that, when the wire is inserted, the relatively sharp edges of the resilient tongues defining said contact slot will first sever the insulation and will then penetrate by a predetermined amount into the core material whereby the electrical contact is made.

For transversely inserting the insulated wire into the slot and for withdrawing an inserted wire from the slot, special tools of the type specified above have been developed which permit reliable wiring, e.g. of terminal strips having a relatively high contact density, even by unskilled operators.

These tools suffer from the disadvantage that they can perform only one function or, respectively, two functions and in addition to that they have a relatively complex structure and entail considerable manufacturing costs.

For instance, to withdraw already connected wires from the terminal element it is necessary to use special withdrawing pliers, and for releasing the terminal elements from their mounting means screw drivers must additionally be used.

It is the object of the present invention to provide a tool of the type mentioned above, which can be manufactured at less expense and which permits additional operations, e.g. cutting of wire ends and withdrawing of connected wires from their terminal elements, to be performed.

In accordance with the present invention the above object is solved in that the ram head includes a longitudinally slotted pressing plate, a stop for limiting the depth of insertion of the wire into the contact slot, and a wire cutter, and that within the grip member formed of two bolted shells there are provided a drawhook adapted to be swung outwardly as well as a pin-and-slot guide for the pivotable scissors blade of the wire cutter, and in that the striker mechanism includes a slider to which the rear end of the ram is detachably coupled and at which a rear compression spring is seated.

In addition to a relatively simple structure the tool, in accordance with the invention, has the further advantage that it is possible in a single operation to urge the wire into the contact slot with an exactly predetermined force and subsequently to cut the wire at a predetermined spacing from the terminal contact, so that, e.g. faulty switching caused by excessively projecting wire ends may reliably be prevented.

Moreover, it is possible to release the electrical connections in a simple manner with the same tool by swinging the drawhook out laterally from the grip member and using it to withdraw the respective wire from its contact slot.

Further advantageous embodiments and developments of the invention form the subject-matter of subclaims.

Figure 1:
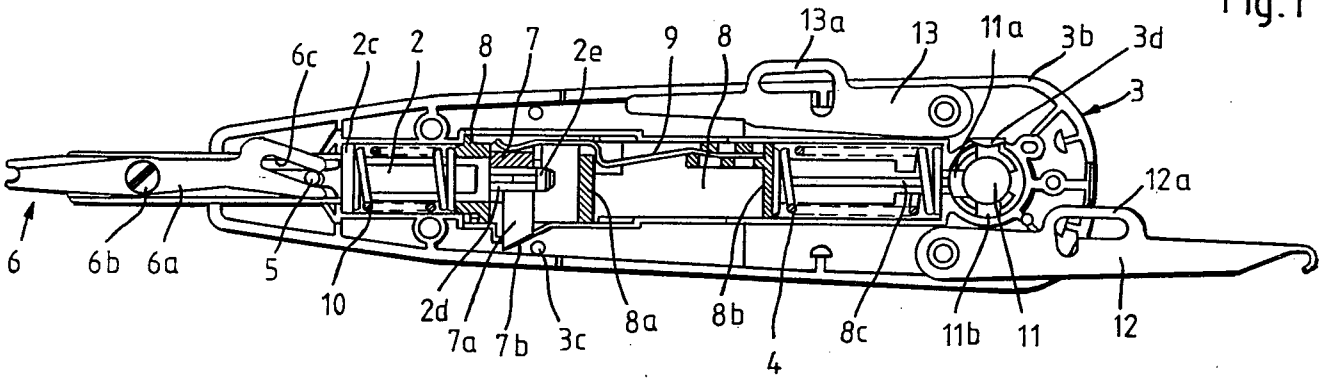

An embodiment of the present invention will now be described with reference to the accompanying drawing, in which:

FIG. 1 is a bottom view, partially in section, of the tool, the lower grip shell having been omitted; and FIG. 1*a* is a side view of the tool shown in FIG. 1.

The tool shown in the drawing comprises a grip member 3 formed of two plastic shells 3*a*, 3*a*, 3*b* bolted to each other. A ram 2 is received in the grip member 3 so as to be longitudinally movable. The portion of the ram 2 projecting from the forward end face of the grip member 3 carries a ram head 2*a* and a longitudinally slotted pressing plate 1 by means of which a wire 1*a* shown in cross-section is pressed or urged into the contact slot of a terminal element, 1*b* the contact slot being in alignment with the longitudinal axis of the tool.

The ram head 2*a* further includes a cross cutter 6 whose movable scissors blade 6*a* is secured to the ram so as to be pivotable about a bolt 6*b* and is formed in its rear end with a longitudinal slot 6*c* inclined relative to the longitudinal axis of the tool. The central portion of the ram 2 includes a shoulder 2*c* for abutment of a compression spring 10, the other end of which rests against the end wall of a hollow slider 8 of rectangular cross-section. The ram extends through the forward end wall of the slider 8. The interior of the slider 8 accommodates a transversely movable U-shaped locking bar 7 through which a lingitudinally profiled extension 2*d* of the ram extends. The locking bar 7 in its one position locks the ram 2 relative to the slider 8. The transverse movement of the locking bar takes place in one direction by means of a pressure spring 9 attached to the slider 8, and in the other direction via an inclined ramp 7*b* formed on a lateral lug 7*a* and cooperating with a pin 3*c* disposed within the grip member 3. The slider 8 includes a centrally positioned intermediate wall 8*a* forming an abutment for an enlarged end plate 2*e* of the ram 2. The rear end of the slider 8 has an end wall 8*b* which functions as a support for a compression spring 4 whose other end is seated against a stop fixedly provided in the housing. A pin 8*c* fixed to the slider extends through the compression spring 4. The rear end of the grip member 3 is provided with a turning knob 11 rotatably mounted in the grip shell by means of a mounting member 3*d*. The externally adjustable turning knob 11 comprises in its portion inside of the grip member a radial bore 11*b* of sufficient size to receive the pin 8*c*, and in another rotary position it comprises a closing member 11*a*. Furthermore, inside of one grip shell a drawhook 12 including a handle 12*a* as well as a flat piercing tool 13 including a handle 13*a* are pivotally mounted; both members 12 and 13 are adapted to be swung inwards and outwards laterally from corresponding side slots formed in the grip member 3 from the rest position shown for the tool 13 into an operating position shown for the drawhook 12, and vice versa.

The operation of the above-described tool is as follows.

For urging a wire 1*a* into the contact slot, a manual force is applied to the tool grip 3 in the direction of the arrow 14 against the force of the two compression springs 4, 10. This force is sufficient to urge the wire 1*a* into the contact slot formed between the two resilient tongues of the terminal element aligned in parallel with the tool axis, thereby cutting the insulation and making an electrical connection between the terminal element and the wire which is protected against mechanical strain. The depth of insertion of the wire into the slot is determined by a limiting stop 2*b* formed at the head 2*a*. The advancing force acting on the grip member 3 causes relative movement between the ram 2 and the grip member 3 as well as between the scissors blade 6*a* of the wire cutter 6 and the pin 5 secured within the grip member. The pin slides into the inclined longitudinal slot 6*c* and thereby pivots the movable scissors blade 6*a* such that the cutting edge formed at the front end of the same will sever the wire 1*a* at a predetermined distance form the terminal connection.

During the first part of this relative movement between the ram 2 and the grip member 3 the ram is locked relative to the slider 8 by means of the locking bar 7. Only after a predetermined distance has been travelled will the ramp 7*b* formed on the lateral lug 7*a* of the locking bar 7 come into engagement with the pin 3*c* fixed to the housing, whereby the locking bar 7 is transversely moved against the action of the spring 9 and under the action of one of the compression springs strikes with its intermediate wall 8*a* against the end plate 2*e* of the ram extension 2*d*. This striking indicates to the operator that the terminating operation has been completed.

In case the wire is not to be severed the rear turning knob 11, which acts as a locking member, has the position shown in FIG. 1 in which the closing member 11*a* closes an aperture formed in the housing and prevents the pin 8*c* attached to the slider 8 from penetrating into said housing aperture. Thus a rigid coupling between the ram having the cross cutter and the grip member has been caused via the slider, so that upon urging of the wire into the contact slot the free scissors blade 6*a* will not be actuated by the pin 5.

The drawhook 12 shown in FIG. 1 is used to withdraw a connected wire from the contact slot of the respective terminal element. The piercing tool 13 permits releasing of latched connections between a connector strip and the mounting means of the same, e.g. by engagement behind integrally formed projections.

What is claimed is:

1. A tool for electrically connecting an insulated wire to a terminal element having two oppositely disposed resilient togues defining a longitudinal contact slot, said tool comprising:

a handle grip member comprising a hollow housing;

a striker mechanism within said housing, said striker mechanism comprising:

a Slider mounted for selective longitudinal movement with respect to said housing;

a rear compression spring normally biasing said slider forwardly with respect to said housing;

a ram member mounted to said housing for selective longitudinal movement with respect thereto, the rearward end of said ram being detachable coupled to said slider for longitudinal movement therewith, the forward end of said ram projecting outwardly from the forward end of said housing;

a longitudinally slotted pressing plate mounted on the forward end of said ram, said plate being adapted to transversely urge the wire into the contact slot in the terminal, said pressing plate being formed with stop means for limiting the depth of insertion of the wire into the contact slot;

a scissors blade pivotably mounted to said ram; and means on said housing for pivoting said blade to sever the wire a predetermined distance from said terminal upon insertion of the wire therein.

2. The tool recited in claim 1 wherein said ram in detachably coupled to said slider by means of a locking bar transversely movable with respect to said slider, said tool further comprising a spring normally urging said locking bar into the coupling position.

3. The tool recited in either claim 1 or 2 and further comprising:

a drawhook element pivotably mounted to said housing; and a piercing tool pivotably mounted to said housing, said drawhook and said piercing tool being pivoted within said housing so as to be swung out laterally therefrom.

4. The tool recited in either of claim 1 or 2 and further comprising locking means within said housing for preventing relative longitudinal movement of said slider and said scissors blade with respect to said housing.

5. The tool recited in claim 4 wherein said locking means comprises a rotatable knob having at least one transverse bore adapted to receive the rearward end of said slider to permit longitudinal motion of said slider with respect to said housing against the bias of said rear compression spring.

6. The tool recited in claim 1 wherein said scissors blade is formed with an oblique slot formed in the rear portion thereof, said means for pivoting said blade comprising a pin mounted to said housing and extending into said oblique slot in said scissors blade whereby longitudinal movement of said ram with respect to said housing causes said scissors blade to rotate.

7. The tool recited in claim 2 wherein:

said transverse locking bar is U-shaped and is formed with an inclined ramp projecting laterally from said slider, said tool further comprising:

a pin mounted to said housing adapted to be engaged by said inclined ramp whereby upon longitudinal movement of said slider, said transverse locking bar moves laterally upon engagement of said pin by said inclined ramp.

8. The tool recited in claim 7 wherein the rear end of said ram extends through said locking bar and is formed with an enlarged abutment, said slider is formed with an intermediate internal wall confronting said enlarged abutment whereby relative movement between said ram and said slider is limited by engagement of said intermediate wall with said abuatment.

9. The tool recited in claim 8 wherein said housing, said ram, said slider and said locking bar are all formed of a substantially rigid plastic material.

* * * * *